United States Patent [19]

Nakaya et al.

[11] 4,345,926

[45] Aug. 24, 1982

[54] EXPANSION ENGINE

[75] Inventors: Shunichi Nakaya, Kawasaki; Katsumasa Araoka, Yokohama, both of Japan

[73] Assignee: Tokyo Shibaura Denki Kabushiki Kaisha, Kawasaki, Japan

[21] Appl. No.: 188,495

[22] Filed: Sep. 18, 1980

[30] Foreign Application Priority Data

Sep. 18, 1979 [JP] Japan ..... 54/119743

[51] Int. Cl.[3] ..... F25J 1/00

[52] U.S. Cl. ..... 62/38; 91/272; 62/403

[58] Field of Search ..... 91/341 R, 271–273; 62/38, 402, 403

[56] References Cited

U.S. PATENT DOCUMENTS

| | | | |
|---|---|---|---|
| 2,209,655 | 7/1940 | Magis | 91/271 |
| 3,137,483 | 6/1964 | Zinkiewicz | 91/272 |
| 3,233,426 | 2/1960 | Cowans | 62/403 |
| 3,464,315 | 9/1969 | Weyer | 91/271 |
| 3,969,984 | 7/1976 | Bouyucos | 91/276 |

FOREIGN PATENT DOCUMENTS

| | | |
|---|---|---|
| 1225496 | 9/1966 | Fed. Rep. of Germany . |
| 1475128 | 3/1970 | Fed. Rep. of Germany . |
| 1108933 | 9/1955 | France . |
| 54-83151 | of 1979 | Japan . |

*Primary Examiner*—Norman Yudkoff

*Attorney, Agent, or Firm*—Oblon, Fisher, Spivak, McClelland & Maier

[57] ABSTRACT

An expansion engine fixed to a flange so as to extend into a vacuum tank comprises an outer cylinder inserted in said vacuum tank and having its proximal end opening into the atmosphere, an inner cylinder removably inserted from its distal side into said outer cylinder through said opening, a piston capable of reciprocating inside said inner cylinder and having an exhaust valve, an intake valve mechanism disposed on the distal side of said inner cylinder and capable of moving together with said inner cylinder, and O-rings disposed between said inner and outer cylinders to seal the interface between said cylinders airtightly.

11 Claims, 4 Drawing Figures

EXPANSION ENGINE

This invention relates to an automatic valve-type expansion engine suited for refrigerating machines such as helium refrigerator-liquefiers.

Generally, engines of this type, in use, are mounted on a flange closing the vacuum tank of a refrigerating machine so that the engine may extend into the vacuum tank. In such a prior art engine, although a piston can be removed from the atmosphere side, an automatic valve, as well as a cylinder, cannot be removed in that manner, remaining inside the vacuum tank. In adjusting or repairing the automatic valve, therefore, the cylinder must be taken out by deliberately breaking the vacuum inside the vacuum tank. The breakage of the vacuum inside the vacuum tank leads to an increase in the cost of the adjustment and repair of the automatic valve, as well as in the time required therefor.

Accordingly, the object of this invention is to provide an expansion engine capable of easily removing an automatic valve from the atmosphere side without breaking a vacuum inside a vacuum tank to which the engine is attached and facilitating the adjustment and repair of the automatic valve.

This invention can be more fully understood from the following detailed description when taken in conjunction with the accompanying drawings, in which.

Now there will be described an adiabatic expansion engine according to an embodiment of this invention to be disposed in the vacuum tank of a refrigerating machine, with reference to the accompanying drawings.

Figure 1:
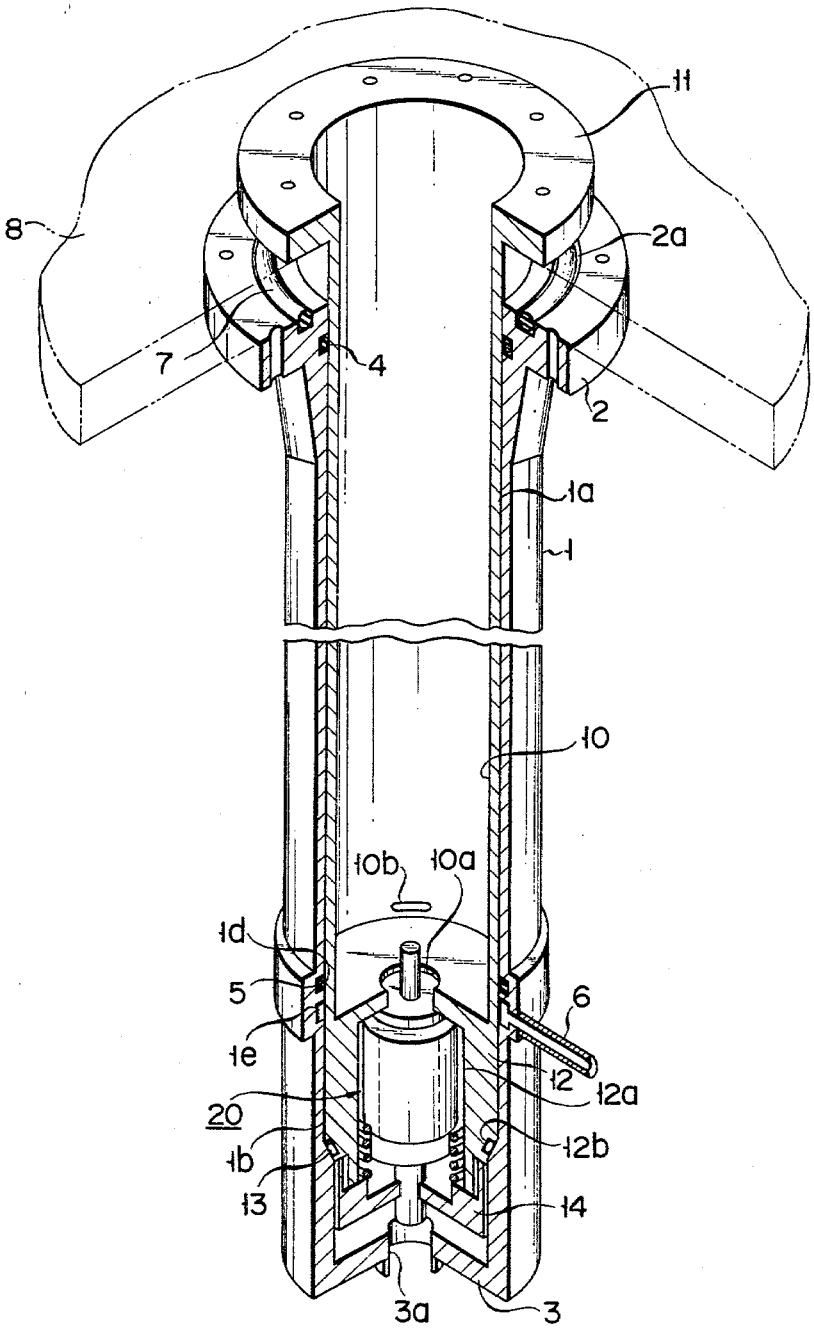
FIG. 1 is a broken away, perspective view of an adiabatic expansion engine according to an embodiment of this invention showing the whole body thereof but a piston.

In FIG. 1, numeral 1 designates an outer cylinder of stainless steel which is opened at both ends and includes an inner cylinder chamber 1*a* located on the proximal side and a valve housing section chamber 1*b* located on the distal side. The inner cylinder chamber 1*a* is in the form of a cylinder which has a uniform inner diameter through the whole length thereof, and the valve housing section chamber 1*b* has an end portion reduced in diameter through a slope in the middle of the chamber 1*b*. A flange 2 integrally protrudes outward from the proximal end portion of the outer cylinder 1, and a discoid base plate 3 with an opening 3*a* in the center is coaxially, integrally formed at the distal opening of the cylinder 1. In the inner peripheral surface of the outer cylinder 1 near the proximal end thereof, there is formed an annular groove 1*c* in which an O-ring 4 of rubber is fitted. In the inner peripheral surface of the outer cylinder 1 near the distal end thereof, on the other hand, there are formed two annular grooves 1*d* and 1*e*. An O-ring 5 of fluoric resin is fitted in the one groove 1*d*. The other groove 1*e* constitutes an exhaust channel for a refrigerant fluid as mentioned later, communicating with an exhaust pipe 6 which is attached to the outer peripheral surface of the outer cylinder 1. On the top or proximal side of the flange 2, there is formed an annular groove 2*a* extending along the circumferential direction, and an O-ring 7 of rubber is fitted in the groove 2*a*. The flange 2 is attached airtightly to a mounting flange 8 by means of bolts through a plurality of tapped holes formed at regular intervals along the circumferential direction so that the top of the flange 2 may face the inside of the mounting flange 8. The mounting flange 8 is attached airtightly to the wall of a vacuum tank (not shown) so as to block up the opening of the vacuum tank. The outer cylinder 1 is inserted from its distal end portion or valve housing section chamber side into the vacuum tank through the opening of the mounting flange 8 so that the whole body of the outer cylinder 1 may be held in a vacuum.

Figure 2:
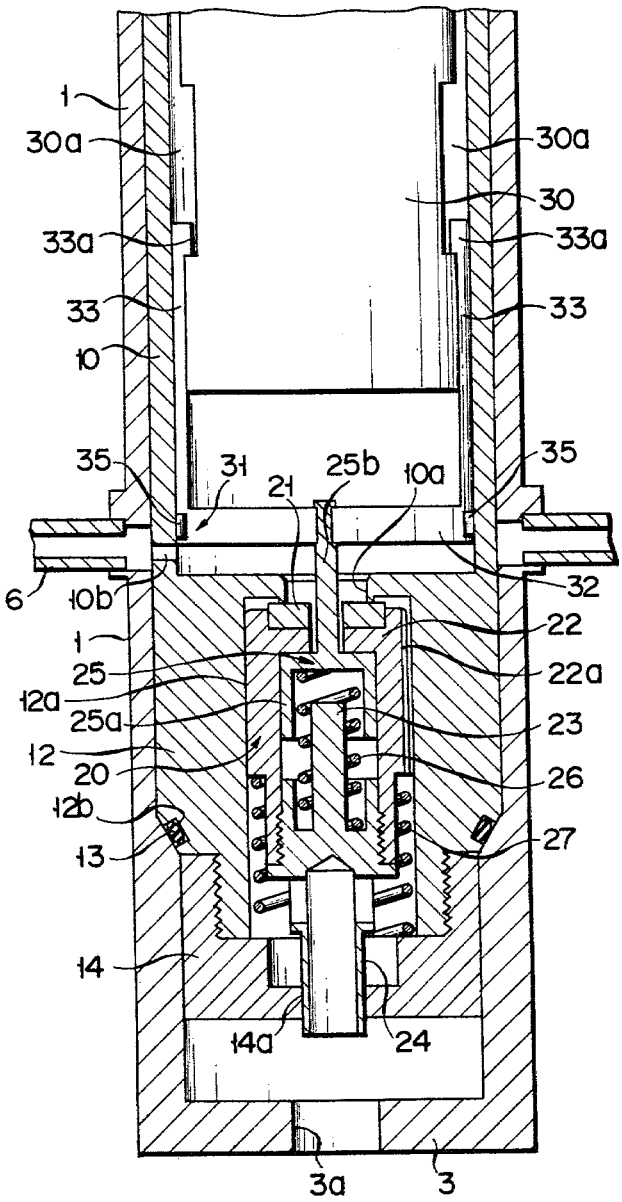
FIG. 2 is a partial sectional view of the engine of FIG. 1.

An inner cylinder 10 with an outer diameter slightly smaller than the inner diameter of the outer cylinder 1 is coaxially fitted in the outer cylinder 1. The inner cylinder 10 is made of stainless steel, and has a flange 11 integrally protruding outward from the proximal opening portion thereof. On the distal side of the inner cylinder 10, as shown in FIG. 2, there is integrally formed a valve housing section 12 to house an automatic valve or intake valve as mentioned later. The valve housing section 12 has the same outer diameter with the inner cylinder 10 and an inner diameter smaller than that of the inner cylinder 10, defining a cylindrical valve chamber 12*a* therein. The top or proximal end of the valve housing section 12, which forms the bottom of the inner cylinder 10, has in its center a circular intake port 10*a* to connect the valve chamber 12*a* with the inner cylinder 10. The distal end portion of the valve housing section 12 is reduced in diameter through a slope which mates with the slope formed in the vicinity of the distal end of the outer cylinder 1. Formed in the slope of the valve housing section 12 is an annular groove 12*b* in which an O-ring 13 of fluoric resin or metal is fitted. An external thread is formed on the outer periphery of the narrowed distal end portion of the valve housing section 12, and mates with an internal thread of a connecting pipe 14. The connecting pipe 14 is housed in the narrowed distal end portion of the outer cylinder 1, and has an opening 14*a* in its center. An exhaust port 10*b* is defined in the side wall of the inner cylinder 10 near the valve housing section 12.

Housed in the valve chamber 12*a*, as shown in detail in FIG. 2, the aforementioned intake valve or valve plug 20 is composed of a valve 21, valve body 22, bottom cover 23, pipe 24, engaging body 25, and first and second springs 26 and 27. The valve 21 is formed of a discoid seal member with an outer diameter greater than that of the intake port 10*a* of the valve housing section 12 and having a through hole in its center, and is coaxially mounted on the top of the valve body 22. The valve body 22 is in the form of a cylinder with an outer diameter a little smaller than the diameter of the valve chamber 12*a* and having its top and bottom ends closed and opened respectively. Formed at the top end of the valve body 22 is a through hole in alignment with the central through hole of the valve 21. A plurality of grooves 22*a* (four grooves in this embodiment) are formed in the outer peripheral surface of the valve body 22 at regular intervals along the circumferential direction thereof, extending in the axial direction of the valve body 22. By means of these grooves 22*a*, an upper section (proximal-side space) and a lower section (distal-side space) of the valve chamber 12*a* divided by the valve body 22 communicate with each other. The engaging body 25 is formed of a tube section 25*a* housed in the valve body 22 and a rod section 25*b* which protrudes integrally from the top of the tube section 25*a* and has its tip end projected into the inner cylinder 10 through the intake port 10*a* as well as through the respective central through holes of the valve body 22 and valve 21. The bottom cover 23 is inserted into the valve body 22 through the bottom opening thereof, an external thread on the cover 23 mating with an internal thread formed on the inner peripheral surface of the valve body 22 so that the valve body 22 may face the tube section 25*a* of the engaging body 25. The pipe 24 protrudes from the under surface of the bottom cover 23, the distal end of the pipe 24 penetrating the opening 14*a* of the connecting pipe 14 and located within a space defined between the under surface of the connecting pipe 14 and the base plate 3 so as to face the opening 3*a* of the base plate 3. Formed in the middle of the pipe 24 is a hole opening into the valve chamber 12*a* of the valve housing section 12. The valve body 22 and the engaging body 25 can move in the axial direction relatively to the valve housing section 12 and the valve body 22, respectively. The first compression coil spring 26 is disposed between the tube section 25*a* of the engaging body 25 and the bottom cover 23 so as normally to urge the engaging body 25 upward, while the second compression coil spring 27 is disposed between the connecting pipe 14 and the valve body 22 so as normally to urge the valve body 22 upward. The spring coefficient of the first spring 26 is designed to be greater than that of the second spring 27.

Now there will be described procedures to incorporate the valve body 20 into the inner cylinder 10.

First, the engaging body 25 and the first spring 26 are inserted into the valve body 22 through the bottom opening thereof, and then the bottom cover 23 is screwed into the valve body 22 to block up the opening. A resultant assembly is inserted into the valve chamber 12*a* of the valve housing section 12 through the bottom opening thereof. Then, the second spring 27 is put in the valve chamber 12*a*, and the valve housing section 12 is screwed into the connecting pipe 14 so that the bottom opening may be blocked up with said connecting pipe 14.

As described above, the incorporation of the valve plug 20 into the distal end portion of the inner cylinder 20, as well as the removal of the former from the latter, can be performed outside the vacuum tank. The inner cylinder 10 fitted with the valve plug 20 is inserted from the atmosphere side, with the valve plug 20 forward, into the outside cylinder which is previously attached to the mounting flange 8 and located inside the vacuum tank. The inner cylinder 10 is inserted to such a degree that the flange 11 of the inner cylinder 10 may come into contact with the outside of the mounting flange 8. The degree of the insertion is controlled by the engagement between the slope on the inner peripheral surface of the outer cylinder 1 and the slope on the outer peripheral surface of the inner cylinder 10. After the insertion, the inner cylinder 10 is attached to the mounting flange 8 by clamping the flange 11 of the inner cylinder 10 on the top of the mounting flange 8 by means of bolts with a belleville spring interposed therebetween. The interface between the inner and outer cylinders 10 and 1 is airtightly sealed by the first and second O-rings 4 and 5 interposed therebetween in the vicinity of the mounting flange 8 and the exhaust pipe 6, respectively. The interface between the outer cylinder 1 and the valve housing section 12 is airtightly sealed by the third O-ring 13 interposed therebetween. In this embodiment, the third O-ring 13 is fitted in the annular groove 1*e* formed in the slope on the outer peripheral surface of the valve housing section 12, so that it is satisfactorily compressed by the belleville spring to augment the sealing effect.

The valve plug 20 constitutes the automatic intake valve, while an automatic exhaust valve is mounted on a piston, according to the aforementioned preferred embodiment of the invention. Referring now to the drawings of FIGS. 2 and 3, the automatic exhaust valve will be described in detail.

Figure 3:
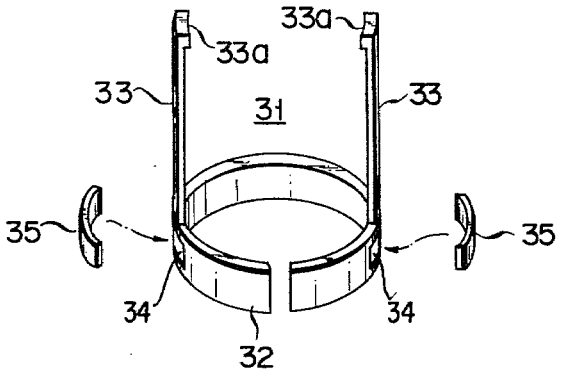
FIG. 3 is a perspective view of a spring ring of an exhaust valve.

A piston 30 is housed in the inner cylinder 10 so as to be able to slide in the axial direction, and a spring ring 32 to constitute an exhaust valve 31 is attached to the bottom end portion of the piston 30. As shown in FIG. 3, the spring ring 32 has a pair of stopper arms 33 extending upward from two opposite positions of the top end face of the spring 32. Stopper claws 33*a* protruding toward the central axis of the piston 30 are formed at the tip ends of the stopper arms 33 so as to face each other. A pair of recesses 34 are formed in two opposite positions on the outer peripheral surface of the spring ring 32, and spring strips 35 so curved as to have their central portions projected from the outer peripheral surface of the spring ring 32 engage the recesses 34, severally. The central portions of the spring strips 35 press against the inner peripheral surface of the inner cylinder 10, blocking up the exhaust port 10*b* of the inner cylinder 10 when the piston 30 is located in its lowermost position. A pair of slots 30*a* extending in the axial direction are formed in two opposite positions in the middle of the outer peripheral surface of the piston 30, and the stopper claws 33*a* are slidably fitted in these slots 30*a*.

Now there will be described the operation of the engine of the aforementioned construction.

When the piston 30 is located in the upper position as shown in FIG. 2, the exhaust valve 31 is open, and the intake valve 20 is closed. When the piston 30 comes close to its bottom dead center after the gas inside the inner cylinder 10 is exhausted through the exhaust port 10*b* as the piston 30 is lowered from the above position, the top end faces of the slots 30*a* of the piston 30 abut against the stopper claws 33*a* to lower the spring ring 32 by means of the stopper claws 33*a* as the piston 30 is further lowered. Finally, the spring strips 35 attached to the spring ring 32 block up the exhaust port 10*b* to bring the exhaust valve 31 to a closed state. When the piston 30 is lowered close to the bottom dead center, moreover, it abuts against the rod section 25*b* of the engaging body 25 to lower the same. Since the spring coefficient of the first spring 26 is greater than that of the second spring 27, therefore, the descending force of the engaging body 25 is transmitted to the valve body 22 through the first spring 26 and the bottom cover 23, thereby lowering the valve body 22 against the urging force of the second spring 27. In consequence, the intake port 10*a* is opened, and the intake valve 20 is brought to an open state. As a result, high-pressure gas is delivered through the opening 3*a* of the base plate 3, pipe 24, and the grooves 22*a* on the valve body 22 to the intake port 10*a*, where it is introduced into the inner cylinder 10. The open state of the intake valve 20 is maintained until the valve body 22 abuts against the connecting pipe 14 to be prohibited from lowering any more so that the engaging body 25 is lowered relatively to the valve body 22 against the urging force of the first spring 26. When the piston 30 reaches the bottom dead center, the first and second springs 26 and 27 are fully compressed. Thereafter, when the piston 30 begins to rise, the engaging body 25 is first raised relatively to the valve body 22 by the urging force of the first spring 26, and the tube section 25*a* of the engaging body 25 abuts against the valve body 22. Then, the valve body 22 and the engaging body 25 are raised in one by the urging force of the second spring 27, and the intake port 10*a* is closed by the valve 21. It will be understood that, in the above construction, the intake valve 20 is opened automatically when the piston 30 is lowered close to the bottom dead center and will not be opened for a short time when the piston 30 rises directly from the bottom dead center. When the piston 30 is raised close to its top dead center, the bottom faces of the slots 30*a* of the piston 30 engage the stoppers 33*a* to raise the same. As a result, the spring ring 32 is raised, and the blocking of the exhaust port 10*b* by the spring strips 35 is released to bring the exhaust valve 31 to the open state as shown in FIG. 2. Thus, accompanying the reciprocation of the piston 30, the intake valve 20 and the exhaust valve 31 are automatically opened and closed to perform the function of the engine.

Figure 4:
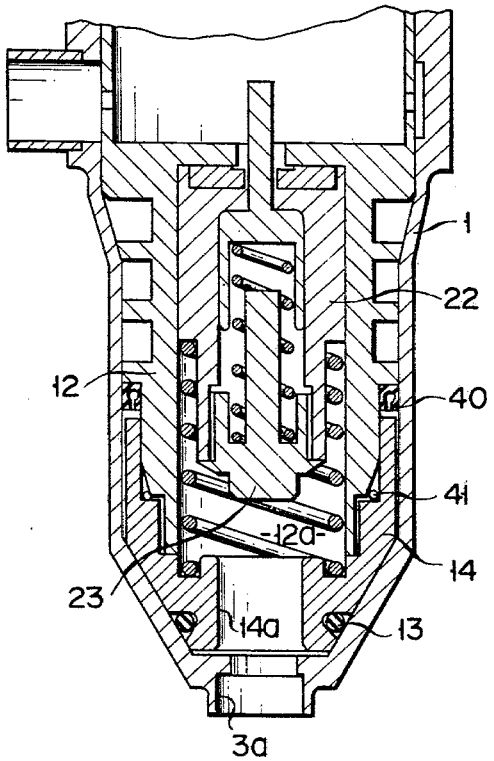
FIG. 4 is a partial sectional view of a modification of the engine.

FIG. 4 partially shows a modification of the engine. In this modification, like reference numerals are used to designate the same portions as in the construction shown in FIG. 2, and detailed description of such portions is omitted.

An outer cylinder 1 has its distal end portion drawn to be gradually tapered, and a connecting pipe 14 also having its distal end portion drawn to be gradually tapered is housed and held in the tapered portion of the outer cylinder 1. The interface between the sloping side walls of the connecting pipe 14 and the outer cylinder 1 is sealed with an O-ring 13. Further, a stepped portion formed on the inner peripheral surface of the connecting pipe 14 engages a stepped portion formed at the distal end of a valve housing section 12, thereby holding the housing section 12. The interface between the connecting pipe 14 and the valve housing section 12 is sealed with an O-ring 40 interposed between those stepped portions. In order to lighten the valve housing section 12, a plurality of annular grooves are formed at regular intervals on the outer peripheral surface of the housing section 12. The interface between the valve housing section 12 and the outer cylinder 1 is sealed with an elastic, annular seal member 41. No pipe protrudes from a bottom cover 23 screwed in a valve body 22, and gas introduced through an opening 3*a* of the outer cylinder 1 is led into a valve chamber 12*a* directly through an opening 14*a* of the connecting pipe 14.

An engine including the intake valve of the construction shown in FIG. 4 performs substantially the same function as the foregoing embodiment.

In the adiabatic expansion engine according to the above-mentioned embodiment, a valve housing section housing an intake valve is formed in the distal end portion of an inner cylinder which is removably fitted in an outer cylinder. Accordingly, the inner cylinder and the intake valve can be removed from the outer cylinder without breaking the vacuum inside the vacuum tank of a refrigerating machine. Thus, the intake valve can be adjusted or repaired with ease. Since the vacuum need not be broken, the adjustment and repair of the intake valve require relatively low cost. Since the interface between the inner and outer cylinders is sealed with O-rings disposed severally on the high-temperature side (near the proximal end) and on the low-temperature side (near the distal end), the sealing against the atmosphere is highly reliable.

The member to seal the interface between the inner and outer cylinders on the atmosphere side is not limited to the O-ring, and may be formed of any packing material provided it is elastic and can airtightly seal the interface. The member to seal the interface on the low-temperature side should preferably have resistance against extremely low-temperature, as well as the packing property. A seal member located in the middle of the inner and outer cylinders will prevent the movement of gas between the cylinders and improve the adiabatic effect.

What we claim is:

1. An expansion engine to be disposed so as to extend into a vacuum tank comprising:

an outer cylinder inserted in said vacuum tank and having its proximal end opening into the atmosphere;

an inner cylinder removably inserted from its distal side into said outer cylinder through said opening;

a piston capable of reciprocating inside said inner cylinder;

an intake valve mechanism disposed on the distal side of said inner cylinder and capable of moving together with said inner cylinder; and seal means to seal the interface between said cylinders airtightly.

2. An expansion engine according to claim 1, wherein said intake valve mechanism includes a cylindrical valve housing section connected with the distal end of said inner cylinder and having a valve chamber defined therein, said valve housing section having an end face to form a bottom of said inner cylinder, an intake port formed in said end face and connecting said valve chamber with said inner cylinder, a ventilation means to introduce the outside air into said valve chamber, and a valve plug driven by the movement of said piston and selectively opening and closing said intake port.

3. An expansion engine according to claim 2, wherein said valve plug includes a valve body slidably disposed inside said valve chamber, a valve mounted on said valve body and capable of opening and closing said intake port, an engaging body slidably disposed inside said valve body and having a rod section capable of engaging said piston, a first spring to urge said engaging body toward said piston, and a second spring to urge said valve body toward said piston, the spring coefficient of said second spring being smaller than that of said first spring.

4. An expansion engine according to claim 2, wherein said inner cylinder has an exhaust port on the peripheral side wall thereof near the bottom, and an exhaust valve mechanism is further disposed inside said inner cylinder.

5. An expansion engine according to claim 4, wherein said exhaust valve mechanism is mounted on said piston and has a valve plug to be operated by the movement of said piston.

6. An expansion engine according to claim 5, wherein said valve body includes a spring ring on the distal side of said piston to be moved downward to close said exhaust port when said piston is lowered close to a bottom dead center thereof and to be moved upward to open said exhaust port when said piston is raised close to a top dead center thereof.

7. An expansion engine according to claim 1, wherein said seal means is interposed between said inner and outer cylinders, and includes a high-temperature side seal ring located in the vicinity of the proximal end of said outer cylinder and a low-temperature side seal ring located between said outer cylinder and said intake valve mechanism.

8. An expansion engine according to claim 7, wherein both said seal rings are O-rings.

9. An expansion engine according to claim 8, wherein said low-temperature side O-ring is made of rubber.

10. An expansion engine according to claim 8, wherein said high-temperature side O-ring is made of fluoric resin or metal.

11. An expansion engine according to claim 7, wherein said seal means includes an O-ring located in the vicinity of said intake mechanism between said inner and outer cylinders.

* * * * *